US006055438A

United States Patent [19]

Winner, Jr.

[11] Patent Number: 6,055,438

[45] Date of Patent: Apr. 25, 2000

[54] EMERGENCY COMMUNICATION SYSTEM FOR AUTOMATIC TELLER MACHINES

[75] Inventor: James E. Winner, Jr., Hollywood Beach, Fla.

[73] Assignee: Winner International Royalty LLC, Sharon, Pa.

[21] Appl. No.: 08/901,222

[22] Filed: Jul. 24, 1997

[51] Int. Cl.[7] ..... H04Q 7/24

[52] U.S. Cl. ..... 455/521; 379/37; 235/379

[58] Field of Search ..... 235/379, 380; 455/521; 379/37

[56] References Cited

U.S. PATENT DOCUMENTS

| | | | |
|---|---|---|---|
| 4,567,358 | 1/1986 | Takamatsu et al. | 235/379 |
| 5,315,511 | 5/1994 | Matsuura et al. | 705/43 |
| 5,354,974 | 10/1994 | Eisenberg | 235/379 |
| 5,451,757 | 9/1995 | Health, Jr. | 235/382 |
| 5,548,632 | 8/1996 | Walsh et al. | 455/521 |
| 5,731,575 | 3/1998 | Zingher et al. | 235/379 |
| 5,780,825 | 7/1998 | Sato et al. | 235/379 |

*Primary Examiner*—William G. Trost
*Assistant Examiner*—Sonny Trinh
*Attorney, Agent, or Firm*—Vickers, Daniels & Young

[57] ABSTRACT

An emergency communication system for use with an automatic teller machine is armed when an authorized user of the machine inserts his or her ATM card to access the machine for a banking service. An emergency 911 button on the machine can be depressed by the user to establish communication with a dispatcher at a 911 emergency station following access and prior to completion of the banking transaction, and the communication system remains armed for a predetermined period of time following completion of the banking transaction and return of the ATM card to the user, whereby communication with the 911 station can be achieved by pressing the 911 emergency button following completion of the transaction with the machine.

21 Claims, 2 Drawing Sheets

EMERGENCY COMMUNICATION SYSTEM FOR AUTOMATIC TELLER MACHINES

BACKGROUND OF THE INVENTION

This invention relates to the art of emergency communication systems and, in particular, to such a system for use with an automatic teller machine.

It is of course well known that automatic teller machines, commonly known as ATM's, are often located in remote and relatively unattended locations wherein there is minimal vehicle and/or pedestrian traffic, whereby persons using the machines for drawing cash from their bank accounts are extremely vulnerable to robberies and/or physical assaults. Such robberies and assaults occur most often after the money has been withdrawn and the user of the machine is leaving the location thereof. In an effort to provide the authorized user of such a machine with the ability to initiate communication with police in the event of an emergency situation in which the user has been or is being or anticipates being accosted or robbed, it has been proposed, as shown in U.S. Pat. No. 5,548,632 to Walsh, et al. to provide an ATM with a two-way communication capability with a dispatcher at an emergency station accessible through a 911 emergency response network. In this respect, an ATM is provided with a push button which activates dialing of the 911 telephone system and which, preferably, requires the insertion of an authorized user's ATM card as a prerequisite to activating the phone call. Once communication is established with the 911 emergency station, microphones and a speaker associated with the ATM enable the dispatcher at the emergency station to monitor sound at the machine and establish two-way communication with the user of the machine and, accordingly, to take such action as may be dictated by the circumstances. While such a system obviously offers more protection for an authorized user at an ATM than that provided by an ATM having no emergency communication capability whatsoever, there are a number of disadvantages which enable a robber or assailant to negate the intended safety provided by the communication system. In this respect, for example, thieves will quickly become aware of the push button on the ATM and its purpose and, therefore, need only to hide and await return of the ATM card to the user which deactivates the push button. The thief can then accost the user and take the money in that activation of the communication system requires reinsertion of the ATM card. Furthermore, a thief can confiscate the card and/or physically preclude reinsertion thereof into the machine and, as a result of such activity, become angry and harm the authorized user. Even if the thief merely takes the card and money from the user and leaves the scene, the authorized user is unable to activate the communication system to report the theft. The thief may also wait for the user to put the card away such as in a purse or billfold so that the card cannot be quickly accessed by the user, whereby the thief can confiscate the money and leave the location before the user can insert the card and activate the communication system. It will be appreciated, of course, that all such delays result in the thief getting further away from the scene of the crime before authorities can be informed thereof and attempt to pursue the perpetrator.

SUMMARY OF THE INVENTION

In accordance with the present invention, an emergency communication system is provided for use with an ATM which maintains desirable attributes while minimizing and/or overcoming the foregoing and other problems and disadvantages encountered in connection with such systems heretofore available. More particularly in this respect, a communication system in accordance with the present invention requires arming of the system by use of a device carried by an authorized user and, for example, by the insertion of an authorized user's ATM card into the machine and, after arming, depression of a push button on the machine to activate the system, thus to avoid activation of the communication system by vandals or the like. Further, once the authorized user has inserted his or her ATM card into the machine, the communication system can be activated at any time during use of the machine by the authorized user simply by depressing the push button on the machine. Thus, the advantageous features of a system such as that disclosed in the Walsh, et at. patent referred to hereinabove are maintained. In accordance with one aspect of the present invention, when the user has completed his or her banking transaction at the machine, whereupon the ATM card is returned to the user, the communication system remains armed for a predetermined period of time such as a minute following return of the card. Accordingly, a thief knowing that the push button is on the machine thinks it is safe to accost the authorized user as soon as the card is returned to the latter. If the user is so accosted, he or she merely needs to push the button to activate the communication system whereupon the dispatcher at the emergency station can monitor what is taking place at the location of the machine. Therefore, even if the thief takes the money and the user's ATM card, the user can immediately communicate with the emergency station merely by pushing the button on the machine. Moreover, this capability exists even if the authorized user has moved away from the machine and is accosted or becomes aware of a potentially dangerous situation, it only being necessary for the user to return to the machine and push the button.

In accordance with another aspect of the invention, the communication system includes a camera in the ATM for transmitting camera signals to a camera signal receiving unit at the emergency 911 station, whereby the dispatcher at the latter station can visually monitor and/or record events taking place at the location of the machine. This capability advantageously provides for identifying a thief or assailant to assist authorities in apprehending the latter. Preferably, the communication system also includes a speaker at the ATM which enables two-way communication between the authorized user and the dispatcher at the emergency station.

It is accordingly an outstanding object of the present invention to provide an improved emergency communication system for use with an automatic teller machine for optimizing the capability of an authorized user of the machine to communicate with an emergency station during or following use of the machine.

Another object is the provision of an emergency communication system of the foregoing character which requires arming of the system through the use of a user portable device and wherein the system remains armed for a period of time following the user's terminating use of the machine for banking services.

Yet another object is the provision of a system of the foregoing character which enables the transmission of both visual and audible information indicative of events taking place at the location of the ATM.

Still another object is the provision of a communication system of the foregoing character which improves the ability and opportunity for an authorized user of an ATM to establish emergency communication with an emergency 911 station during the user's operation of the machine for banking purposes or within a predetermined period of time following the user's completion of the business transaction with the machine.

BRIEF DESCRIPTION OF THE DRAWINGS

The foregoing objects, and others, will in part be obvious and in part pointed out more fully hereinafter in conjunction with the written description of a preferred embodiment of the invention illustrated in the accompanying drawings in which.

DESCRIPTION OF A PREFERRED EMBODIMENT

Figure 1:
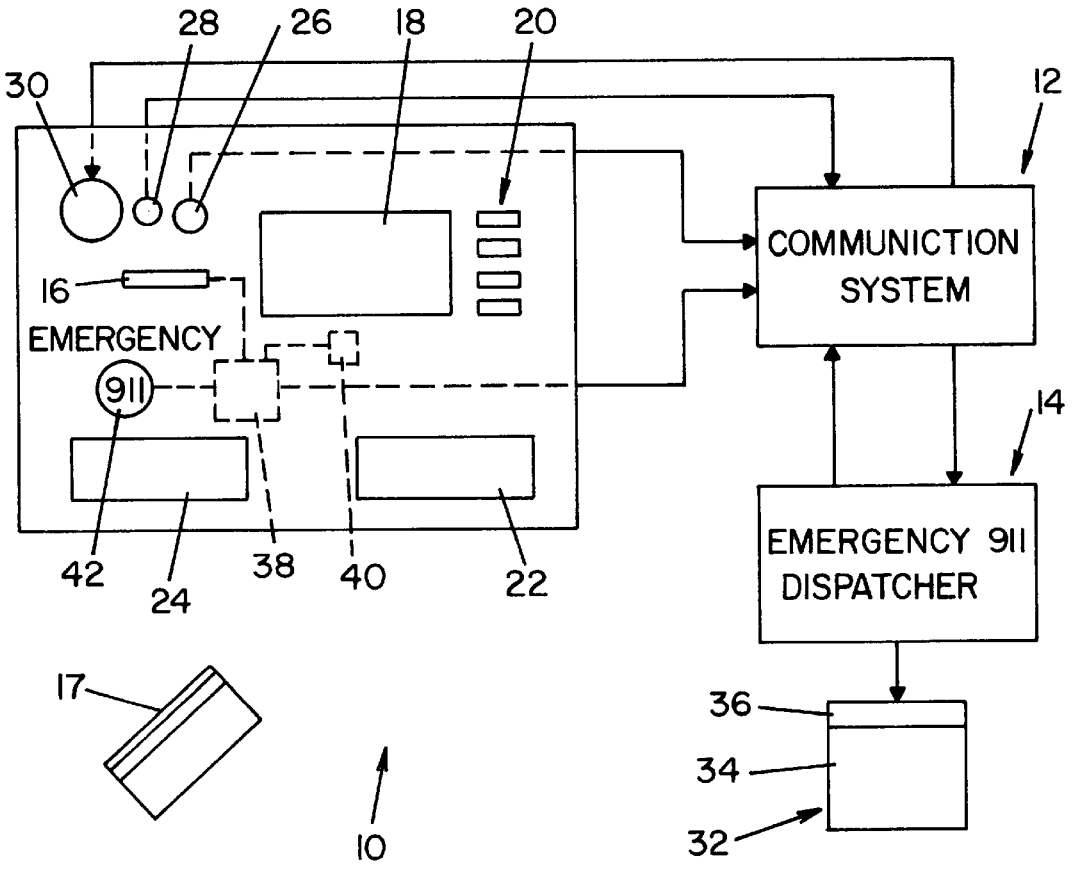
FIG. 1 is a block diagram showing an emergency communication system in accordance with the invention; and, FIG. 2 is a flow chart showing operation of the system illustrated in FIG. 1.

Referring now in greater detail to the drawings, wherein the showing are for the purpose of illustrating a preferred embodiment of the invention only and not for the purpose of limiting the invention, FIG. 1 illustrates an ATM 10 having an emergency communication system 12 associated therewith in accordance with the present invention for establishing communication between a user of the ATM and a dispatcher at a 911 emergency response station 14. In a well known manner, ATM 10 includes a card slot 16 for receiving an authorized user's ATM card 17, a window or screen 18 visually indicating information relating to a banking transaction taking place during use of the machine, keys 20 by which the user selects between offered banking services at the machine, a keypad 22 for inputting a user code into the machine, and a money slot 24 through which the user receives money withdrawn from his or her account.

Communication system 12 has unarmed, armed and activated conditions, as set forth in greater detail hereinafter, and includes a microphone 26, a television camera 28 and a speaker 30 in ATM 10 which provide visual and two-way audible communication between the location of ATM 10 and the dispatcher at station 14 when the communication system is activated. In connection with such visual communication, emergency station 14 can be provided with a television camera signal receiving unit 32 which can include a television receiver 34 for viewing the area where ATM 10 is located and a videotape recorder 36 by which that being viewed by the camera can be recorded. Communication system 12 further includes a microprocessor or microchip 38 which receives activating input in response to the introduction of a user's ATM card into slot 16, from a timer 40, and from a user operable emergency push button 42 on the ATM. As will become apparent hereinafter, microprocessor 38 and timer 40 are operable to arm the communication system and to maintain the system armed for a period of time following use of the machine for performing a banking service, and push button 42 is operable to activate the communication system when the system is armed and the button is depressed.

As is well known, ATM 10 normally is in an inoperable condition with respect to performing banking services and is adapted to be shifted to an operable condition upon the insertion of an ATM card into slot 16 by an authorized user and the entry of a valid code through the depression of buttons on keypad 22. When the transaction is completed, the ATM card is returned to the user through slot 16 and the machine shifts back to the inoperable condition. As mentioned above, communication system 12 has unarmed, armed and activated conditions. The system is normally unarmed and, when an authorized user inserts his or her ATM card into slot 16 and enters a valid code so as to shift the ATM to its operable condition microprocessor 38 is activated to shift the communication system from the unarmed to the armed condition thereof. Assuming that the desired banking transaction is completed by the user without any problems necessitating use of the emergency communication system, the ATM card is returned to the user through slot 16 and ATM 10 returns to its inoperable condition as described above. In accordance with the invention, return of the ATM card to the user activates timer 40 whereby microprocessor 38 maintains the communication system in its armed condition for a predetermined period of time, preferably between 30 and 60 seconds and, most preferably for 60 seconds. Following expiration of the period of time, microprocessor 38 is deactivated, whereby the communication system is shifted back to its unarmed condition.

From the foregoing description, it will be appreciated that communication system 12 and ATM 10 are normally or initially in a first operating mode in which the communication system is unarmed and the machine is inoperable for performing banking services. It will likewise be appreciated that the ATM card, ATM 10 and microprocessor 38 are operable for sequentially shifting the communication system and the machine from the first operating mode to a second mode in which the communication system is armed and the machine is operable to perform banking functions, and then to a third mode in which the communication system remains armed and the machine shifts back to its inoperable condition. Still further, it will be appreciated that timer 40 is operable through microprocessor 38 in the third mode to maintain the communication system in its armed condition for a predetermined period of time following which it shifts back to the unarmed condition. Accordingly, the emergency communication system is armed in both the second and third modes of operation of the ATM and communication system, the latter mode being established when the authorized user has completed a banking transaction, presumably has received money from the machine and the ATM card and is ready to or is leaving the vicinity of the machine. Thus, should the user be approached, accosted or for any reason become fearful of impending danger, either during use of the ATM or for a period of time following such use, the user merely needs to press emergency button 42 on the machine which operates through microprocessor 38 to shift communication system 12 from the armed to the activated condition thereof, whereupon 911 station 14 is dialed to establish communication between the ATM user and a dispatcher at the latter station.

Figure 2:
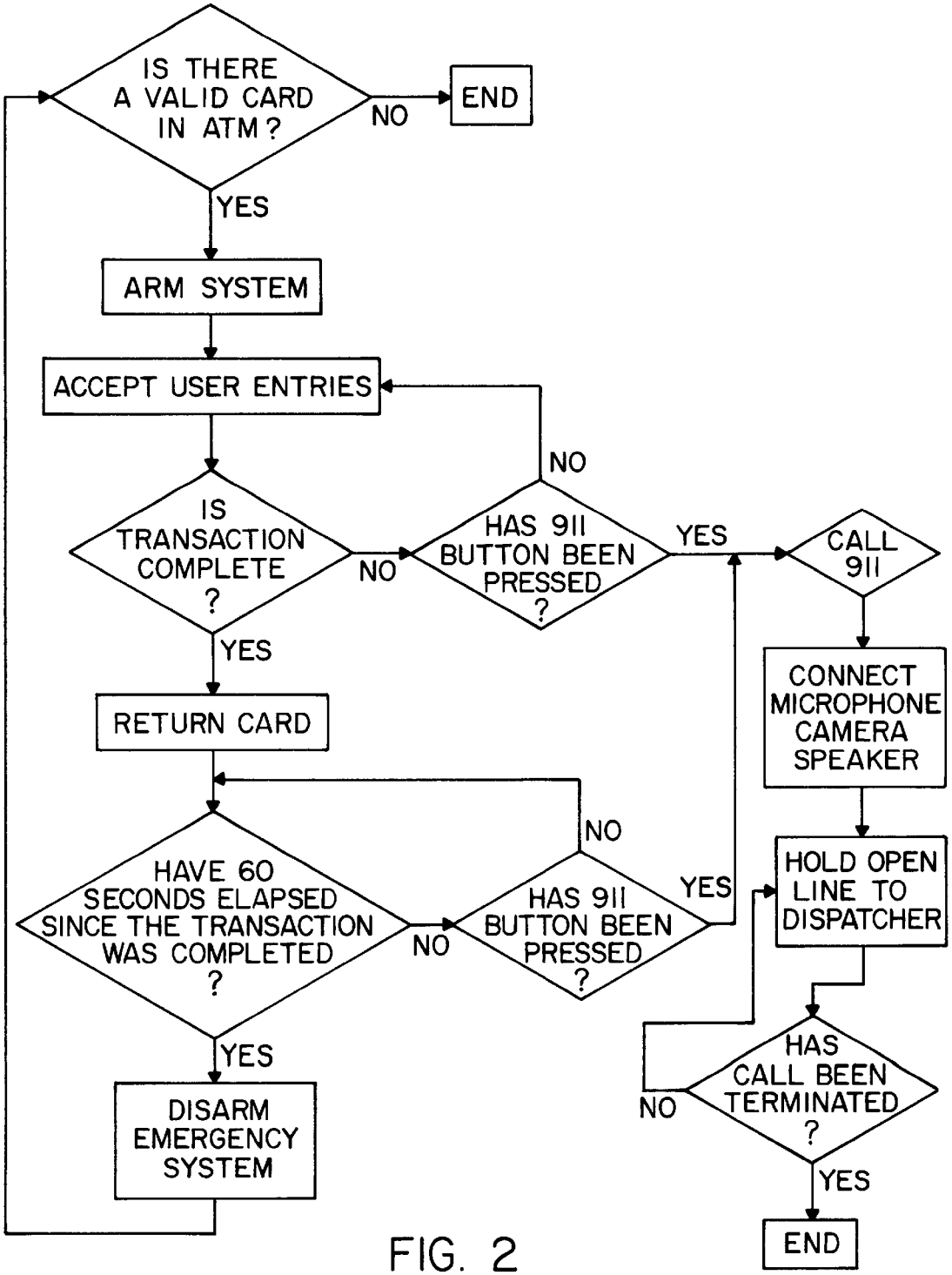

It is believed that operation of the emergency communication system in conjunction with use of ATM 10 will be understood from the foregoing description of FIG. 1 and the following sequence of operating events shown in the flow chart of FIG. 2 of the drawing. With reference to the latter Figure, until such time as a valid ATM card is received in ATM 10 the machine is inoperable for performing banking services and the communication system is unarmed, whereby the system and machine are in the first mode described above. When a valid ATM card is received in the machine, the communication system is armed and the machine is operable for receiving user entries and performing banking transactions, and the system and machine are in the second mode described above. Presuming that the transaction continues without incident, the communication system remains armed and the machine continues to accept user entries in connection with the transaction or until such time as the transaction is completed. If the transaction is completed without incident, the ATM card is returned to the user whereby the machine is shifted back to its inoperable condition with respect to performing a banking service and the communication system remains armed for a period of time following the completed transaction which is indicated to be 60 seconds in FIG. 2. At this time, the system and machine are in the third operating mode described above. Again presuming the time period to elapse without incident, the communication system shifts back to the unarmed condition thereof, whereupon the machine and communication system are again in the first operating mode described above.

Presuming now that the user is accosted or otherwise becomes fearful of his or her safety when the machine and system are in the second mode and prior to completion of the banking transaction, the user merely needs to depress the emergency 911 button 42 to activate the emergency communication system, whereupon the latter calls the 911 emergency station 14. When the latter call is answered by a dispatcher at the 911 station, microphone 26, camera 28 and speaker 30 are connected in communication between ATM 10 and 911 station 14 whereby the dispatcher at the latter station can listen to and observe events taking place at the location of the ATM and, if desired, carry on two-way communication with the ATM user and/or other persons at the ATM location. Communication system 12 is also operable through microprocessor 38 to maintain communication with 911 station 14 until such time as the call thereto is terminated by the dispatcher, whereby even if the user is forced to complete the transaction and the user's ATM card is returned when the transaction is completed, the lines of communication between the ATM and 911 dispatcher remain open, all of which allows the dispatcher to alert and send authorities to the location of the machine and, if appropriate, to keep the authorized user aware of the situation in this respect.

Most often, a would-be thief will await completion of the banking transaction by the ATM user and movement of the latter away from the machine which indicates completion of the transaction and possession of money by the user. In accordance with the present invention, the user seeing such a person approaching and fearing theft and/or physical harm, can activate the emergency communication system simply by returning to the ATM and pushing 911 button 42. Even if the user is accosted and precluded from returning to the machine and the perpetrator takes the user's money and ATM card, the user has the opportunity to quickly report the crime by returning to the machine within the allotted time and again merely pressing the 911 emergency button. Under these circumstances, it is not necessary to again reactivate the system by introducing the ATM card and obtaining verification of the validity thereof in order to enable activation of the communication system. Accordingly, protection for the authorized user as well as the ability to timely report a theft or other situation is optimized by delaying shifting of the communication system from the armed to the unarmed condition thereof following completion of the banking transaction by the ATM user. Further in connection with this feature, it will be appreciated that any time period can be provided for maintaining the communication system in its armed condition. When the communication system has been activated and the 911 call is ultimately terminated by the 911 dispatcher, the communication system returns to its unarmed condition.

While considerable emphasis has been placed on the preferred embodiment herein illustrated and described, it will be appreciated that other embodiments can be made and that many modifications can be made in the preferred embodiment without departing from the principals of the invention. In this respect, for example, the user portable activator disclosed herein as an ATM card could be a personalized radio transmitter carried by the user, in which case the ATM would have an appropriate receiver for identifying an authorized user of the ATM and shifting the latter to its operable condition and the communication system to its armed condition upon receiving a valid identification. Further, while it is preferred to have the 911 emergency button visible as a deterrent to a would-be thief by indicating 911 communication capability at the machine, it will be appreciated that the button for activating the communication system could be incorporated in the keypad of the ATM so as to enable an authorized user of the machine who has been accosted during operation thereof to inconspicuously activate the communication system in conjunction with use of the keypad to complete the transaction. These and other modifications of the preferred embodiment as well as other embodiments of the invention will be suggested and obvious to those skilled in the art from the disclosure herein, whereby it is to be distinctly understood that the foregoing descriptive matter is to be interpreted merely as illustrative of the present invention and not as a limitation.

Having thus described the invention, it is so claimed:

1. An emergency communication system for use with an automatic teller machine and by an authorized user operating the machine for performing banking transactions, said system having unarmed, armed and activated conditions and including means for establishing communication between the user and a dispatcher at an emergency station having a 911 telephone number when said system is in the activated condition, said machine having operable and inoperable conditions for performing banking transactions, means including user portable activating means for sequentially shifting said system and said machine from a first to a second and then to a third operating mode, said system being unarmed and said machine being inoperable in said first mode, said system being armed and said machine being operable in said second mode, said system being armed and said machine being inoperable in said third mode, user operable activating means on said machine for shifting said system from said armed to said activated condition when said system and said machine are in said second and third operating modes, and means for shifting said system and said machine from said third mode to said first mode a predetermined period of time following shifting thereof from said second mode to said third mode.

2. The system according to claim 1, wherein said user portable activating means includes a card and said machine includes means for receiving the card from and returning the card to the user.

3. The system according to clam 2, wherein said system and said machine are in said first operating mode prior to the machine receiving the card from the user, shift to said second mode upon receiving the card from the user, shift to the third mode upon returning the card to the user, and shift from the third mode to the first mode said predetermined period of time following said returning of the card.

4. The system according to claim 3, wherein said means for shifting said system and said machine from said third mode to said first mode includes timer means activated in response to said returning of said card.

5. The system according to claim 1, wherein said user operable activating means is push button operated.

6. The system according to claim 1, wherein said means for shifting said system and said machine from said third mode to said first mode includes timer means activated in response to shifting said system and said machine to said third mode.

7. The system according to claim 1, wherein said communication system includes microphone means on said machine for monitoring sound and transmitting sound signals to said emergency station.

8. The system according to claim 1, wherein said communication system includes camera means on said machine for transmitting camera signals to a camera signal receiver at said emergency station.

9. The system according to claim 1, wherein said user portable activating means includes a card and said machine includes means for receiving the card from and returning the card to the user and wherein said means for shifting said system and said machine from said third mode to said first mode includes timer means activated in response to said returning of said card.

10. The system according to claim 9, wherein said user operable activating means is push button operated.

11. The system according to claim 10, wherein said communication system includes microphone means on said machine for monitoring sound and transmitting sound signals to said emergency station.

12. The system according to claim 11, wherein said communication system includes camera means on said machine for transmitting camera signals to a camera signal receiver at said emergency station.

13. An emergency communication system for use with an automatic teller machine and by an authorized user operating the machine for performing banking transactions, said system having unarmed, armed and activated conditions and including means for establishing communication between the user and a dispatcher at an emergency station having a 911 number when said system is in said activated condition, activating card means for insertion in said machine by the user for shifting said system from said unarmed to said armed condition and for establishing operation of the machine for banking transactions, said machine including means for returning the card to the user, selectively operable activating means on said machine for shifting said system from said armed to said activated condition, and means for maintaining said system in said armed condition for a period of time following return of said card from said machine.

14. The system according to claim 13, wherein said communication system includes microphone means on said machine for monitoring sound and transmitting sound signals to said emergency station.

15. The system according to claim 13, wherein said communication system includes camera means on said machine for transmitting camera signals to a camera signal receiver at said emergency station.

16. The system according to claim 13, wherein said means for maintaining said system in said armed condition includes timer means activated in response to return of said card from said machine.

17. The system according to claim 13, and means for shifting said system from said armed condition to said unarmed condition upon termination of said period of time.

18. The system according to claim 13, wherein said activating means is push button operated.

19. The system according to claim 18, wherein said means for maintaining said system in said armed condition includes timer means activated in response to return of said card from said machine and means for shifting said system from said armed condition to said unarmed condition upon termination of said period of time.

20. The system according to claim 15, wherein said communication system includes microphone means on said machine for monitoring sound and transmitting sound signals to said emergency station.

21. The system according to claim 20, wherein said communication system includes camera means on said machine for transmitting camera signals to a camera signal receiver at said emergency station.

* * * * *